US010083783B2

(12) United States Patent
Fujikawa et al.

(10) Patent No.: US 10,083,783 B2
(45) **Date of Patent: *Sep. 25, 2018**

(54) RARE EARTH BASED MAGNET

(71) Applicant: TDK CORPORATION, Tokyo (JP)

(72) Inventors: Yoshinori Fujikawa, Tokyo (JP); Yuki Nagamine, Tokyo (JP); Wakako Okawa, Tokyo (JP); Chikara Ishizaka, Tokyo (JP); Eiji Kato, Tokyo (JP); Katsuo Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 666 days.

This patent is subject to a terminal disclaimer.

(21) Appl. No.: 14/579,315

(22) Filed: Dec. 22, 2014

(65) Prior Publication Data

US 2015/0179319 A1 Jun. 25, 2015

(30) Foreign Application Priority Data

Dec. 20, 2013 (JP) ..... 2013-263368

(51) Int. Cl.
*H01F 1/057* (2006.01)

(52) U.S. Cl.
CPC ..... *H01F 1/057* (2013.01); *H01F 1/0577* (2013.01)

(58) Field of Classification Search
CPC ..... H01F 1/057; H01F 1/0577
USPC ..... 148/302
See application file for complete search history.

(56) References Cited

U.S. PATENT DOCUMENTS

| | | | | |
|---|---|---|---|---|
| 2012/0024429 | A1 | 2/2012 | Hayakawa et al. | |
| 2012/0235778 | A1 | 9/2012 | Kunieda et al. | |
| 2013/0092868 | A1* | 4/2013 | Nakajima | C22C 38/005 252/62.51 R |
| 2014/0132377 | A1 | 5/2014 | Nakajima et al. | |
| 2014/0191833 | A1 | 7/2014 | Sakuma et al. | |
| 2015/0179317 | A1* | 6/2015 | Fujikawa | H01F 1/0577 420/83 |

(Continued)

FOREIGN PATENT DOCUMENTS

| | | | |
|---|---|---|---|
| JP | 2002327255 | A | 11/2002 |
| JP | 2003-031409 | A | 1/2003 |

(Continued)

*Primary Examiner* — Jie Yang
(74) *Attorney, Agent, or Firm* — Oliff PLC

(57) ABSTRACT

The present invention provides a rare earth based magnet in which the demagnetization rate at a high temperature can be inhibited even if the amount of heavy rare earth element(s) such as Dy and Tb is evidently decreased compared to the past or no such heavy rare earth element is used. The rare earth based magnet of the present invention is a sintered magnet which comprises $R_2T_{14}B$ crystal grains as the main phases and the crystal boundary phases among $R_2T_{14}B$ crystal grains. The microstructure of the sintered body is controlled by at least containing the first crystal boundary phases and the second crystal boundary phases, wherein the first crystal boundary phases contain at least R-T-M in the ranges of 20 to 40 atomic % for R, 60 to 75 atomic % for T and 1 to 10 atomic % for M, and the second crystal boundary phases contains at least R-T-M in the ranges of 50 to 70 atomic % for R, 10 to 30 atomic % for T and 1 to 20 atomic % for M.

5 Claims, 4 Drawing Sheets

(56) References Cited

U.S. PATENT DOCUMENTS

| | | | | |
|---|---|---|---|---|
| 2015/0179318 | A1* | 6/2015 | Fujikawa | C22C 38/001<br>420/83 |

FOREIGN PATENT DOCUMENTS

| | | | | |
|---|---|---|---|---|
| JP | 2011-216678 | A | 10/2011 | |
| JP | 2012015168 | A | 1/2012 | |
| JP | 2012015169 | A | 1/2012 | |
| JP | WO 2012002060 | A1 * | 1/2012 | C22C 38/005 |
| JP | 2012-199270 | A | 10/2012 | |
| JP | 2012-212808 | A | 11/2012 | |
| JP | 2013-013870 | A | 1/2013 | |
| JP | 2013-045844 | A | 3/2013 | |
| WO | 2013008756 | A1 | 1/2013 | |

* cited by examiner

RARE EARTH BASED MAGNET

The present invention relates to a rare earth based magnet, especially a rare earth based magnet in which the microstructure of the R-T-B based sintered magnet is controlled.

BACKGROUND

The R-T-B based sintered magnet (R represents a rare earth element, T represents at least one iron family element with Fe as essential, and B represents boron) represented by the Nd—Fe—B based sintered magnet has a high saturation magnetic flux density. Thus, it is useful for the minimization and efficiency improvement of the equipments used and can be used in a voice coil motor of a hard disk drive. Recently, such magnets are also applied to motors in various fields or drive motors for hybrid vehicles. From the view point of energy saving or the like, it is desired that more such magnets will be used in these fields. However, during the application of R-T-B based sintered magnets in hybrid vehicles or the like, the magnets are exposed to a relatively high temperature. In this respect, it is important to inhibit the demagnetization at a high temperature caused by heat. Further, it is well known that the demagnetization at a high temperature can be effectively inhibited by sufficiently improving the coercivity (Hcj) of the R-T-B based sintered magnet at room temperature.

For example, as a well known method for improving the coercivity of the Nd—Fe—B based sintered magnet at room temperature, part of Nd in the $Nd_2Fe_{14}B$ compound (which is the main phase) is replaced with the heavy rare earth element(s) such as Dy or Tb. The magneto crystalline anisotropy constant can be improved by replacing part of Nd with the heavy rare earth element(s). As a result, the coercivity of the Nd—Fe—B based sintered magnet at room temperature can be improved sufficiently. Besides the replacement of heavy rare earth element(s), the addition of Cu or the like will also elevate the coercivity at room temperature (Patent Document 1). The addition of Cu will render Cu form, for example, the Nd—Cu liquid phase in the crystal boundary so that the crystal boundary will become smooth. In this way, the reverse magnetic domains can be prevented from generating.

On the other hand, Patent Documents 2, 3 and 4 have disclosed a technology that the crystal boundary phase (which is the microstructure of the rare earth based magnet) is controlled to improve the coercivity. It can be known from the drawings of these Patent Documents that the crystal boundary phases refer to the crystal boundary phases surrounded by three or more main phase crystal grains and are also called the triple junction points. In Patent Document 2, a technology has been disclosed for forming two kinds of triple junction points with different Dy concentrations. That is, it has been disclosed that crystal boundary phases (triple junction points) are formed with part areas having a high concentration of Dy and the total concentration of Dy unchanged so that a high resistance with respect to the reversal of the magnetic domain can be maintained. The Patent Document 3 has disclosed a technology that three kinds of crystal boundary phases (triple junction points) (the first one, second one and third one) are formed with different total atomic concentrations of rare earth elements, wherein the atomic concentration of rare earth elements in the third crystal boundary phase is lower than that in other two crystal boundary phases, and the atomic concentration of Fe in the third crystal boundary phase is higher than that in other two crystal boundary phases. In this way, a third crystal boundary phase with a high Fe concentration can be formed in the crystal boundary phases, resulting in the improvement of coercivity. In addition, Patent Document 4 has disclosed an R-T-B based rare earth based sintered magnet which is formed by a sintered body, and the sintered body consists of main phases (which mainly contains $R_2T_{14}B$) and crystal boundary phases with more R than the main phases. The crystal boundary phases contain phases with the total atomic concentration of rare earth elements being 70 atomic % or more and phases with the total atomic concentration of rare earth elements being 25 to 35 atomic %. The phases with the total atomic concentration of rare earth elements being 25 to 35 atomic % are referred to as the transition metal-rich phases, and the atomic concentration of Fe in these phases are preferably 50 to 70 atomic %. In this respect, coercivity is improved.

PATENT DOCUMENTS

Patent Document 1: JP2002-327255
Patent Document 2: JP2012-15168
Patent Document 3: JP2012-15169
Patent Document 4: International Publication Pamphlet No. 2013/008756

SUMMARY

When an R-T-B based sintered magnet is used at a high temperature such as 100° C. to 200° C., the value of coercivity at room temperature is one of the effective indexes. However, it is important to inhibit the occurrence of demagnetization or to have a low demagnetization rate when the magnet is actually exposed to a high temperature environment. When part of R in the $R_2T_{14}B$ compound (i.e., the main phase) is replaced with a heavy rare earth element such as Tb or Dy, the coercivity at room temperature is evidently improved. It is an easy way to improve the coercivity, but the source of the heavy rare earth elements such as Dy and Tb may be problematic because the places of origin and outputs are limited. With such replacements, the decrease of residual flux density is unavoidable due to for example the antiferromagnetic coupling of Nd and Dy. Further, the addition of Cu as described above and the like are also effective to improve the coercivity. However, in order to extend the applicable fields for the R-T-B based sintered magnets, the demagnetization at a high temperature (the demagnetization caused by the exposure to a high temperature environment) is expected to be further inhibited.

Besides the addition of Cu, it is well known that it is important to control the crystal boundary phases which are the microstructure if the coercivity of the rare earth based magnets (i.e., the R-T-B based sintered magnets) is to be improved. In the crystal boundary phases, there are the so-called two-grain boundary phases formed between two adjacent main phase crystal grains and the so-called triple junction points surrounded by three or more main phase crystal grains. As mentioned below, the triple junction point is simply referred to as the crystal boundary phase hereinafter in this specification.

However, it is well known that the coercivity at room temperature is highly improved with the replacement of heavy rare earth elements such as Dy and Tb but the magneto crystalline anisotropy constant (the main factor for the coercivity) dramatically changes as the temperature varies. That is, when the temperature becomes high in the environment where rare earth based magnets are used, the coercivity dramatically decreases. Thus, the inventors have found that it is important to control the microstructure as shown below to obtain a rare earth based magnet with demagnetization at a high temperature being inhibited. If the coercivity can be improved by controlling the microstructure of the sintered magnets, the obtained rare earth based magnet will have excellent temperature stability.

If the coercivity of the rare earth based magnet is to be improved, it is important to cut off the magnetic coupling among $R_2T_{14}B$ crystal grains (which are the main phases). If the major crystal grains can be magnetically isolated, the adjacent crystal grains will not be affected even if reverse magnetic domains are generated in some certain crystal grains. In this respect, the coercivity can be improved. In Patent Documents 2, 3 and 4, the coercivity is improved by forming several kinds of crystal boundary phases (triple junction points) with different constitutions. However, it is not clear what kind of structure of the crystal boundary phases (triple junction points) will result in sufficient magnetic isolation among main phase crystal grains. Especially in the technologies disclosed in Patent Documents 3 and 4, crystal boundary phases with a lot of Fe atoms are formed. With only such a structure, the magnetic coupling among main phase crystal grains may not be sufficiently inhibited.

The inventors of the present invention believe that it is important to control the crystal boundary phases (triple junction points) during the formation of the two-grain boundary phases with good effect on cutting off the magnetic coupling between adjacent crystal grains. In this respect, kinds of conventional rare earth based magnets have been studied. For example, if nonmagnetic two-grain boundary phases can be formed with a relatively high concentration of the rare earth element R by increasing the ratio of R (which is a constituent of the magnet), sufficient effect on cutting off the magnetic coupling can be expected. Actually, if only the ratio of R (which is a constituent of the alloy raw materials) is elevated, the concentration of the rare earth element R in the two-grain boundary phases will not become higher and the ratio occupied by the crystal boundary phases (triple junction points) with a relatively high concentration of the rare earth element R is increased. Thus, dramatic improvement of the coercivity is not achieved with the residual flux density decreasing to an extreme extent instead. In addition, when the atomic concentration of Fe is increased in the crystal boundary phases (triple junction points), the concentration of rare earth element R has not become higher in the two-grain boundary phases. Thus, the magnetic coupling will not be sufficiently cut off and the crystal boundary phases (triple junction points) will become phases with ferromagnetism. These phases will easily become the nucleation point for the reverse magnetic domains, which is the cause of the decreased coercivity. Thus, it has been realized that the degree of cutting off the magnetic coupling between adjacent crystal grains is not enough in conventional rare earth based magnets having triple junction points.

In view of the problems mentioned above, the present invention aims to significantly inhibit the demagnetization rate at a high temperature in the R-T-B based sintered magnet (i.e., the rare earth based magnet).

In order to significantly inhibit the demagnetization rate at a high temperature, the inventors of the present invention have studied the structure of the main phase crystal grains and triple junction points in the sintered body of the rare earth based magnets, wherein the triple junction points may form two-grain boundary phases which cut off the magnetic coupling between adjacent main phase crystal grains. As a result, the following invention has been completed.

The rare earth based magnet of the present invention is a sintered magnet containing $R_2T_{14}B$ crystal grains (which are the main phases), two-grain boundary phases between two $R_2T_{14}B$ crystal grains, and triple junction points. When the microstructure of the sintered body is observed at any section, the phase surrounded by three or more main phase crystal grains is referred to as the crystal boundary phase. Also, the crystal boundary phase containing at least R-T-M with R, T and M respectively accounting for 20 to 40 atomic %, 60 to 75 atomic % and 1 to 10 atomic % is referred to as the first crystal boundary phase, and the crystal boundary phase containing at least R-T-M with R, T and M respectively accounting for 50 to 70 atomic %, 10 to 30 atomic % and 1 to 20 atomic % is referred to as the second crystal boundary phase. The sintered body contains at least these two kinds of crystal boundary phases. With such a composition, the absolute value of the demagnetization rate at a high temperature is inhibited to a level of 4% or less. M represents at least one selected from the group consisting of Al, Ge, Si, Sn and Ga.

More preferably, the ratio of the area of the first crystal boundary phase to the area of the second crystal boundary phase is 0.5 or more at the sections. With such a ratio, the absolute value of the demagnetization rate at a high temperature can be inhibited to a level of 3% or less.

In the rare earth based magnet of the present invention, by forming the crystal boundary phases like this, the first and second crystal boundary phases will not become ferromagnetic compounds even if T is contained therein. Meanwhile, the T atom such as the Fe atom unevenly distributed in the conventional R—Cu two-grain boundary phases is consumed in the forms of the first and second crystal boundary phases. In this respect, the concentration of iron family element(s) in the phases can be lowered extremely, and the two-grain boundary phase becomes a non-ferromagnetic phase. By doing this, when the non-ferromagnetic phase formation of the first and second crystal boundary phases (triple junction points) combined with the decrease of the concentration of the iron family elements in the two-grain boundary phases, the adjacent main phase crystal grains will be magnetically isolated and the demagnetization rate at a high temperature can be inhibited.

Further, it can be known from the comparison between the second crystal boundary phase and the first crystal boundary phase that the second crystal boundary phase takes up and consumes less T atoms such as Fe atoms than the first crystal boundary phase as it has a lower concentration of T than the first crystal boundary phase. Thus, the concentration of T in the two-grain boundary phases can be effectively decreased by properly forming the first crystal boundary phases which take up and consume more T atoms.

As for the rare earth based magnet of the present invention, M is contained in the sintered body. The first crystal boundary phases and the second crystal boundary phases containing R-T-M can be formed in the sintered body by adding the rare earth element R and iron family element T (which are the constituents of the main phase crystal grains) and element M (which forms the ternary eutectic point with R and T). As a result, the concentration of T in the two-grain boundary phases can be lowered. The addition of M promotes the generation of the R-T-M-containing crystal boundary phase, and the element T present in the two-grain boundary phases is consumed during the generation of the crystal boundary phase, which may be the reason why the concentration of T is decreased in the two-grain boundary phases. In addition, the crystal boundary phases containing R-T-M are considered as compounds, and these crystal boundary phases become non-ferromagnetic crystal boundary phases although Fe is contained. After the crystal boundary phases consisting of R-T-M based compounds are analyzed via the electron microscopy and the electron holography, it can be known that the crystal boundary phases become non-ferromagnetic phases which are presumed to be antiferromagnetic or ferrimagnetic with a quite low magnetization value although Fe is contained therein. As the iron family element T is contained as a constituent of the compound and non-ferromagnetic crystal boundary phases are formed even if the iron family elements such as Fe and Co are contained, it is believed that the nucleation of the reverse magnetic domains can be prevented.

As the element M which promotes the reaction together with R and T (which two elements constitute the main phase crystal grains mentioned above), Al, Ga, Si, Ge, Sn and the like can be used.

According to the present invention, a rare earth based magnet with a small demagnetization rate at a high temperature can be provided as well as a rare earth based magnet applicable to motors used under high temperature environments.

DETAILED DESCRIPTION OF EMBODIMENTS

Hereinafter, the preferable embodiments of the present invention will be described with reference to the drawings. The rare earth based magnet of the present invention is a sintered magnet comprising main phase crystal grains of $R_2T_{14}B$, two-grain boundary phases and crystal boundary phases (triple junction points), wherein R contains one or more rare earth elements, T contains one or more iron family elements with Fe as essential, and B represents boron. In addition, various well known additive elements are added and inevitable impurities are contained.

Figure 1:
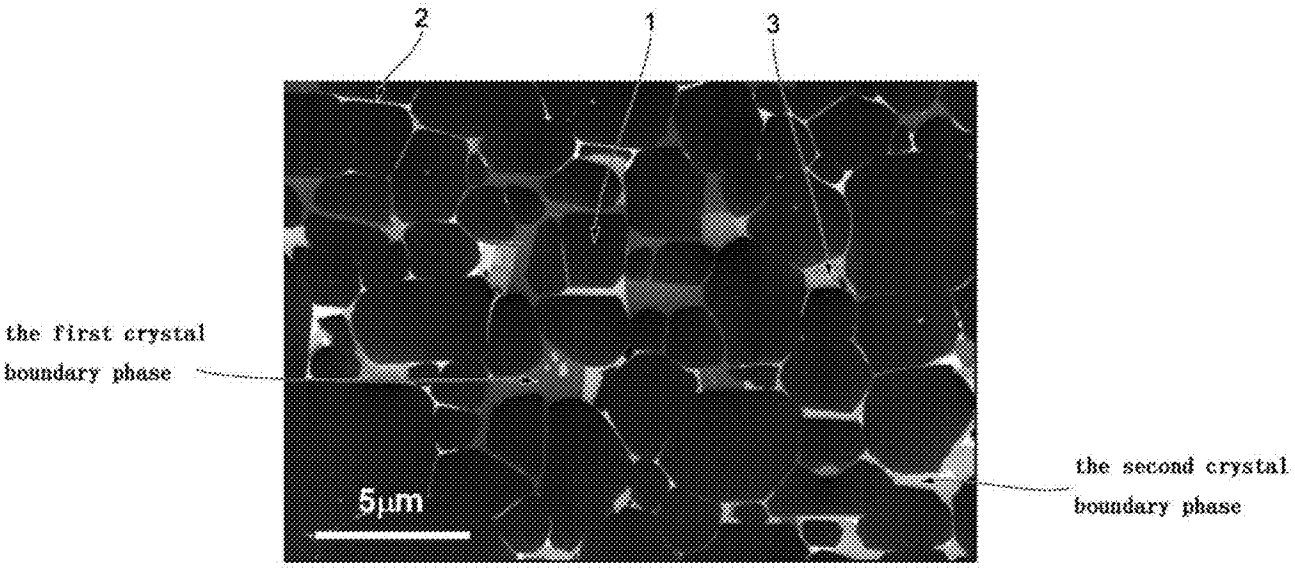
FIG. 1 is an electron micrograph showing the crystal boundary phases of the rare earth based magnet of Example 4 according to an embodiment of the present invention.
Figure 2:
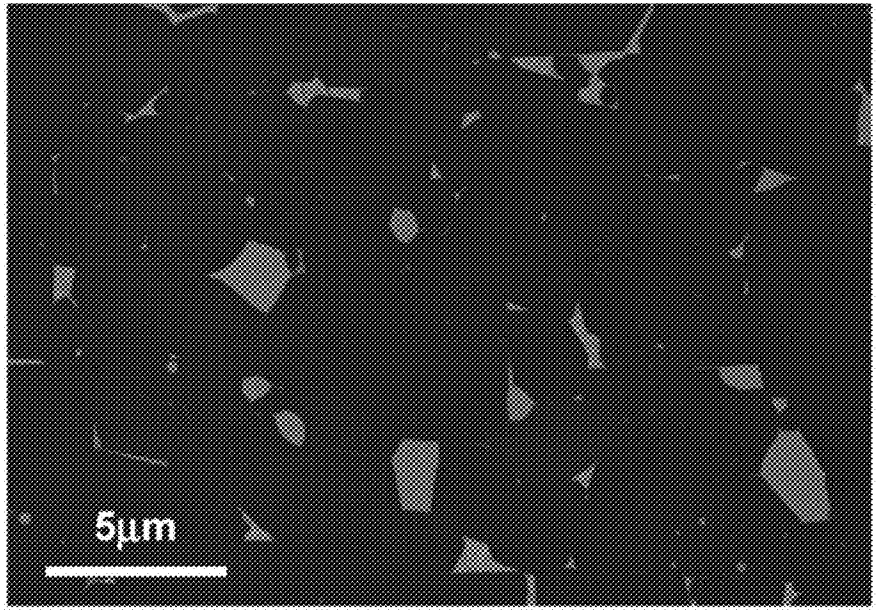
FIG. 2 is an electron micrograph showing the crystal boundary phases of the rare earth based magnet of Comparative Example 2 of the present embodiment.

FIG. 1 is an electron micrograph showing the structure at a section of the rare earth based magnet in an embodiment of the present invention. The rare earth based magnet of the present embodiment comprises the main phase crystal grains 1 (which are mainly composed of $R_2T_{14}B$), the two-grain boundary phases 2 formed between two adjacent main phase crystal grains 1, and the crystal boundary phases 3 surrounded by three or more main phase crystal grains. When the crystal boundary phases containing at least R-T-M with R, T and M respectively in the ranges of 20 to 40 atomic %, 60 to 75 atomic % and 1 to 10 atomic % is referred to as the first crystal boundary phases and the crystal boundary phases containing at least R-T-M with R, T and M respectively in the ranges of 50 to 70 atomic %, 10 to 30 atomic % and 1 to 20 atomic % is referred to as the second crystal boundary phases, the rare earth based magnet contains at least these two kinds of crystal boundary phases.

In the main phase crystal grains of $R_2T_{14}B$ which constitute the rare earth based magnet of the present embodiment, the rare earth element R can be any one of the light rare earth element, the heavy rare earth element or their combination. In view of the cost of the materials, Nd or Pr or their combination is preferable. The other elements are as mentioned above. The preferable range for the combination of Nd and Pr will be described below.

The rare earth based magnet of the present embodiment may contain a trace of additive elements. As the additive element, well known additive elements can be used. The additive elements are preferably those having a eutectic composition with R, wherein R is the constituent of the main phase crystal grains of $R_2T_{14}B$. Thus, the additive element is preferred to be Cu. However, other elements can also be used. The proper range for Cu to be added will be described below.

The rare earth based magnet of the present embodiment may further contain Al, Ga, Si, Ge, Sn and the like as the element M which promotes the reaction in the powder metallurgical processes of the main phase crystal grains. The appropriate amount of M to be added will be described below. With the addition of M in the rare earth based magnet, reactions happen in the surface layer of the main phase crystal grains. Thus, the distortions and defects will be eliminated while the generation of the crystal boundary phases containing R-T-M will be promoted via the reaction between the element T existing in the two-grain boundary phases and the element M. As a result, the concentration of T is decreased in the two-grain boundary phases.

In the rare earth based magnet of the present embodiment, the amount of each element relative to the total mass is as follows.

R: 29.5 to 33 mass %;
B: 0.7 to 0.95 mass %;
M: 0.03 to 1.5 mass %;
Cu: 0.01 to 1.5 mass %, and
Fe: balance, substantially.

The total content of elements other than Fe occupying the balance: 5 mass % or less.

The R contained in the rare earth based magnet of the present embodiment will be more specifically described. R must contain either one of Nd and Pr. As for the ratio of Nd and Pr in R, the sum of Nd and Pr may accounts for 80 to 100 atomic % or 95 to 100 atomic %. If the ratio is within such a range, good residual flux density and coercivity can be further obtained. In addition, in the rare earth based magnet of the present embodiment, the heavy rare earth element such as Dy, Tb or the like can be contained as R. In this case, as for the amount of the contained heavy rare earth element based on the total mass of the rare earth based magnet, the sum of the heavy rare earth elements accounts for 1.0 mass % or less, and preferably 0.5 mass % or less, and more preferably 0.1 mass % or less. In the rare earth based magnet of the present embodiment, even if the amount of the heavy rare earth elements is decreased, a high coercivity can still be obtained and the demagnetization rate at a high temperature can still be inhibited by rendering the amount and atomic ratio of other elements meet certain requirements.

In the rare earth based magnet of the present embodiment, the amount of B is 0.7 to 0.95 mass %. The reaction at the surface of the main phase crystal grains will easily occur during the powder metallurgical processes in combination with the additive elements through the amount of B being less than the stoichiometric ratio of basic component $R_2T_{14}B$.

The rare earth based magnet of the present embodiment further contains a trace of additive elements. As the additive elements, well known additive elements can be used. The additive element is preferably those having a eutectic point with the element R (which is the constituent of the main phase crystal grains of $R_2T_{14}B$) in the phase diagram. In this respect, Cu or the like is preferred as the additive element. Also, other elements can be used. The amount of added Cu is 0.01 to 1.5 mass % based on the whole. If the added amount is within this range, Cu will almost unevenly distribute only in the two-grain boundary phases and the crystal boundary phases (i.e., the triple junction points). On the other hand, as for the element T (which is the constituent of the main phase crystal grains) and Cu, such a combination will hardly have a eutectic point as the phase diagram of, for example, Fe and Cu is monotectic. Therefore, the element M is preferably added which will have a eutectic point in the R-T-M ternary system. As such an element M, it can be Al, Ga, Si, Ge, Sn or the like. In addition, the amount of M is 0.03 to 1.5 mass %. By setting the amount of M within this range, the reaction at the surface of the main phase crystal grains is promoted in the powder metallurgical processes. That is, M reacts with T existing in the two-grain boundary phases so that the generation of the crystal boundary phases containing R-T-M can be promoted and the concentration of element T will be decreased in the two-grain boundary phases.

In the rare earth based magnet of the present embodiment, the element T in the basic component of $R_2T_{14}B$ has Fe as essential and may also contain other iron family elements. Co is preferred as the iron family element. In this case, the amount of Co is preferably ranges from a level above 0 mass % to a level that is under 3.0 mass %. If Co is contained in the rare earth based magnet, the curie temperature will be elevated and the corrosion resistance will be improved too. The amount of Co may also be 0.3 to 2.5 mass %.

The rare earth based magnet of the present embodiment may also contain C as additional elements, and the amount of C is 0.05 to 0.3 mass %. If less C is contained, the coercivity will become insufficient. If more C is contained, the ratio of the value of the magnetic field (Hk) to the coercivity, i.e., the squareness ratio (Hk/coercivity) will become insufficient, where the magnetic field (Hk) is the field when the magnetization becomes 90% of the residual flux density. In order to obtain better coercivity and squareness ratio, the amount of C may also be 0.1 to 0.25 mass %.

The rare earth based magnet of the present embodiment may also contain O as additional elements, and 0.03 to 0.4 mass % of O can be contained. If less O is contained, the corrosion resistance of the sintered magnet will not be sufficient. If more O is contained, the liquid phase will not be sufficiently formed in the sintered magnet and the coercivity will decrease. In order to obtain better corrosion resistance and coercivity, the amount of O can be 0.05 to 0.3 mass % or 0.05 to 0.25 mass %.

Further, in the sintered magnet of the present embodiment, the amount of N is preferably 0.15 mass % or less. If more N is contained, the coercivity tends to be insufficient.

Preferably, in the sintered magnet of the present embodiment, when the amount of each element falls within the ranges mentioned above and the numbers of C, O and N atoms are respectively referred to as [C], [0] and [N], $[0]/([C]+[N])<0.60$. With such a composition, the absolute value of demagnetization rate at a high temperature can be inhibited to a low level.

In addition, in the sintered magnet of the present invention, the numbers of Nd, Pr, B, C and M atoms satisfy the correlations below. In other words, when the numbers of Nd, Pr, B, C and M atoms are respectively referred to as [Nd], [Pr], [B], [C] and [M], it is preferable that $0.27<[B]/([Nd]+[Pr])<0.40$ and $0.07<([M]+[C])/[B]<0.60$. With such a composition, a high coercivity can be maintained.

Hereinafter, an example of the method for preparing the rare earth based magnet of the present embodiment will be described. The rare earth based magnet of the present embodiment can be prepared by a common powder metallurgical method which comprises a preparation process for preparing the alloy raw materials, a pulverization process in which fine powers are obtained by pulverizing alloy raw materials, a molding process in which the fine powders are molded to make a molded body, a sintering process in which the molded body is fired to get a sintered body, and a heat treating process in which an aging treatment is applied to the sintered body.

The preparation process is a process in which alloy raw materials having elements contained in the rare earth based magnet of the present embodiment are prepared. First of all, starting metals with specified elements are prepared for the strip casting method and the like. In this way, the alloy raw materials are prepared. The starting metals can be for example the rare earth based metal or the rare earth based alloy, the pure iron, the ferro-boron, or the alloys thereof. These starting metals are used to prepare alloy raw materials from which rare earth based magnets with a desired composition can be obtained.

In the pulverization process, fine powder raw materials are obtained by pulverizing the alloy raw materials obtained from the preparation process. This process is preferably performed in two stages, i.e., the coarse pulverization process and fine pulverization process. Also, this process can be done in one stage. In the coarse pulverization process, for example, the stamp mill, the jaw crusher, the braun mill and the like can be used under an inert atmosphere. Also, the hydrogen decrepitation can be performed in which pulverization is performed after the hydrogen is adsorbed. In the coarse pulverization process, the alloy raw materials are pulverized until a particle size of several hundreds of micrometers to several millimeters is achieved.

In the fine pulverization process, the coarse powders obtained in the coarse pulverization process are finely pulverized to prepare fine powders with an average particle size of about several micrometers. The average particle size of the fine powders can be set depending on the growth of the sintered crystal grains. The fine pulverization can be performed by using for example a jet mill.

The molding process is a process in which the fine powder raw materials are molded in a magnetic field to make a molded body. Specifically, after the fine powder raw materials are filled in a mold disposed in an electromagnet, the molding is performed by orientating the crystallographic axis of the fine powder raw materials by applying a magnetic field via the electromagnet, while pressurizing the fine powder raw materials. The molding process in the magnetic field can be performed in a magnetic field of for example 1000 to 1600 kA/m under a pressure of about 30 to 300 MPa.

The sintering process is a process in which the molded body is fired to obtain a sintered body. After molded in a magnetic field, the molded body can be fired under vacuum or an inert atmosphere to get a sintered body. Preferably, the firing conditions are properly set based on the composition of the molded body, the pulverization method for getting the fine powders, the grain size or the like. For example, this process may be performed for about 1 to 10 hours at a temperature of 1000° C. to 1100° C.

The heat treating process provides an aging treatment to the sintered body. After this process, the structure of the crystal boundary phases among adjacent main phase crystal grains of $R_2T_{14}B$ is determined. However, the microstructures are determined by not only this process but also the conditions of the sintering process as well as the state of the fine powders. Thus, the correlation between the conditions of the heat treatment and the microstructure of the sintered bodies should be considered while the temperature, duration and the cooling rate in the heat treatment should be set. The heat treatment may be performed at a temperature of 400° C. to 900° C. Alternatively, this process can be performed in several stages. For example, a heat treatment around 850° C. is done followed by a heat treatment at about 550° C. The microstructure may also be changed by the cooling rate of the cooling process in the heat treatment, and the cooling rate is preferably 100° C./min or more and especially preferably 300° C./min or more. According to the aging process of the present embodiment, as the cooling rate is larger than that in conventional processes, the uneven distribution of phases with ferromagnetism can be effectively inhibited in the crystal boundary phases. Thus, the causes that lead to the lowered coercivity and deterioration of the demagnetization rate at a high temperature can be eliminated. The structure of the crystal boundary phase can be controlled by variously setting the composition of the alloy raw materials and the conditions for the sintering process and the heat treatment. Here, an example of the heat treating process has been described as a method for controlling the structure of the crystal boundary phases. However, the structure of the crystal boundary phase may also be controlled according to the constituents listed in Table 1 and table 2.

The rare earth based magnet of the present embodiment can be obtained by the method mentioned above. However, the preparation method of the rare earth based magnets is not limited thereto and can be appropriately changed.

Next, the evaluation of the demagnetization rate at a high temperature for the rare earth based magnet of the present embodiment will be described. The shape of the sample to be evaluated is not particularly restricted and can be one with a permeance coefficient of 2 which is commonly used. First of all, the residual magnetic flux of the sample is measured at room temperature (25° C.) and is set as B0. The residual magnetic flux can be measured by for example a fluxmeter. Then, the sample is exposed to a high temperature of 140° C. for 2 hours and then cooled back to the room temperature. Once upon the temperature of the sample is back to the room temperature, the residual magnetic flux is measured again and set as B1. The demagnetization rate D at a high temperature is evaluated as $D=(B1-B0)/B0\times100$ (%).

The microstructure of the rare earth based magnet of the present embodiment (i.e., the composition and area ratios of various crystal boundary phases) can be evaluated via EPMA (wavelength dispersive typed energy spectroscopy). An observation is provided to the polished section of the sample whose demagnetization rate at a high temperature has been evaluated. Photos are taken for the sample with a magnification that about 200 main phase grains can be seen at the polished section. Also, the magnification can be determined based on the size or the distribution state of each crystal boundary phase. The polished section can be in parallel to the orientation axis or be orthogonal to the orientation axis or can form any degree with the orientation axis. The section is subjected to a plane analysis via EPMA. Thus, the distribution state of each element becomes clear as well as the distribution states of the main phases and each crystal boundary phase. In addition, each crystal boundary phase contained in the visual field of the plane analysis is subjected to the point analysis via EPMA. The composition is determined quantitatively and the areas for the first crystal boundary phases and the areas for the second crystal boundary phases are specified. Based on the results from the plane analysis and the point analysis via EPMA, the area ratios of the first crystal boundary phases and the second boundary phases in the visual field are calculated. In other words, the area ratio here refers to the ratio of the area of either the first or the second crystal boundary phases to the area of visual field. A series of measures are provided to multiple (>3) sections of the magnet sample, and the area ratios of the first crystal boundary phases and the second crystal boundary phases to the whole of the analyzed visual field are calculated as the representative value for each phase. In addition, the average of the composition of the first crystal boundary phases is obtained as the representative value for the first crystal boundary phases in this sample. Similarly, the average of the composition of the second crystal boundary phases is obtained as the representative value for the second boundary phases in this sample.

Hereinafter, the present invention will be more specifically described based on specific examples. However, the present invention is not limited to these examples.

EXAMPLES

First of all, the starting metals for the sintered magnet were prepared and then subjected to the strip casting method. In this way, each alloy raw materials were prepared, wherein the compositions for the sintered magnets of Examples 1 to 31 and Comparative Examples 1 to 3 shown in Tables 1 and 2 can be obtained from these alloy raw materials. In addition, as for the amount of each element shown in Table 1, the amounts of T, R, Cu and M were measured by the X-Ray fluorescence spectrometry and that of B was measured by the ICP atomic emission spectroscopy. Further, the amount of 0 can be measured by an inert gas fusion-nondispersive infrared absorption method, and that of C can be measured by a combustion in oxygen flow-infrared absorption method. As for N, the amount can be measured by the inert gas fusion-thermal conductivity method. In addition, with respect to [O]/([C]+[N]), [B]/([Nd]+[Pr]) and ([M]+[C])/[B], the number of atoms of each element was determined based on the amount obtained via these methods.

Next, after the hydrogen was adsorbed to the obtained alloy raw materials, the hydrogen decrepitation process was performed with hydrogen releasing at 600° C. under Ar atmosphere for 1 hour. Then, the resultant pulverized substances were cooled to room temperature under Ar atmosphere.

Oleic amides as the pulverization agent were added to the pulverized substances and then mixed. Thereafter, a jet mill was used to perform the fine pulverization so that powder raw materials were obtained with an average particle size of 3 to 4 μm.

The resultant powder raw materials were molded under a low-oxygen atmosphere at a magnetic field for orientation of 1200 kA/m with a molding pressure of 120 MPa. In this respect, a molded body was obtained.

The molded body was fired under vacuum at 1030 to 1050° C. for 2 to 4 hours. Then, the molded body was quickly cooled to obtain a sintered body. The obtained sintered body was subjected to a heat treatment with two stages. The first stage (the heat treatment at 900° C.) (aging 1) was performed for 1 hour. As for the heat treatment of the second stage (aging 2), the temperature, duration and cooling rate were changed to prepare multiple samples with different growth states of the crystal boundary phases. Further, as mentioned above, the growth states of the crystal boundary phases would change depending on the composition of the alloy raw materials and the conditions of the firing process.

For the samples obtained above, a B-H tracer was used to measure the residual flux density and the coercivity. Then, the demagnetization rate at a high temperature was measured. For each sample in the Examples and Comparative Examples whose magnetic properties had been measured, the polished sections were observed via EPMA to identify the crystal boundary phases and to evaluate the composition and area ratio of each crystal boundary phase at the polished section. First of all, the magnetic properties of each sample, the situation that whether the first and second crystal boundary phases had been generated, and the representative value of the composition were summarized in Table 1. Based on the composition and area ratios (shown in Table 2), the sample in which the first crystal boundary phases and the second boundary phases can be observed was represented by the symbol '○' and others were represented by the symbol 'x' in Table 1. If the area ratio was lower than 0.1%, the phase cannot be actually seen. Thus, the sample would be classified into the 'x' group. Besides the magnetic properties, Table 2 also showed the representative value of the area ratio for the first crystal boundary phases and the representative value of the area ratio for the second crystal boundary phases.

When the numbers of C, O, N, Nd, Pr, B and M atoms contained in the sintered body were respectively referred to as [C], [O], [N], [Nd], [Pr], [B] and [M], the values of [O]/([C]+[N]), [B]/([Nd]+[Pr]) and ([M]+[C])/[B] were calculated for each sample and listed in Table 3.

TABLE 1

| | Composition of sintered magnet (mass %) | | | | | | | | | | | | | | |
|---|---|---|---|---|---|---|---|---|---|---|---|---|---|---|---|
| | R | | | | | | M | | | | | | | | |
| Sample No. | Sum | Nd | Pr | Dy | B | Cu | Al | Ga | Si | Ge | Sn | Fe | N | C | O |
| Example 1 | 33.0 | 33.0 | 0.0 | 0.0 | 0.70 | 0.7 | 0.2 | 1.3 | 0.0 | 0.0 | 0.0 | bal. | 0.05 | 0.15 | 0.10 |
| Example 2 | 33.0 | 33.0 | 0.0 | 0.0 | 0.70 | 0.7 | 0.2 | 1.3 | 0.0 | 0.0 | 0.0 | bal. | 0.05 | 0.15 | 0.09 |
| Example 3 | 32.5 | 32.5 | 0.0 | 0.0 | 0.80 | 0.4 | 0.2 | 0.7 | 0.0 | 0.0 | 0.0 | bal. | 0.04 | 0.14 | 0.09 |
| Example 4 | 32.5 | 32.5 | 0.0 | 0.0 | 0.80 | 0.4 | 0.2 | 0.7 | 0.0 | 0.0 | 0.0 | bal. | 0.04 | 0.13 | 0.08 |
| Example 5 | 32.0 | 32.0 | 0.0 | 0.0 | 0.83 | 0.1 | 0.2 | 0.5 | 0.0 | 0.0 | 0.0 | bal. | 0.04 | 0.14 | 0.09 |
| Example 6 | 32.0 | 32.0 | 0.0 | 0.0 | 0.83 | 0.1 | 0.2 | 0.5 | 0.0 | 0.0 | 0.0 | bal. | 0.05 | 0.13 | 0.08 |
| Example 7 | 32.0 | 32.0 | 0.0 | 0.0 | 0.83 | 0.1 | 0.2 | 0.5 | 0.0 | 0.0 | 0.0 | bal. | 0.04 | 0.13 | 0.07 |
| Example 8 | 32.0 | 32.0 | 0.0 | 0.0 | 0.83 | 0.1 | 0.2 | 0.5 | 0.0 | 0.0 | 0.0 | bal. | 0.04 | 0.14 | 0.06 |
| Example 9 | 32.0 | 32.0 | 0.0 | 0.0 | 0.83 | 0.1 | 0.2 | 0.0 | 0.3 | 0.0 | 0.0 | bal. | 0.04 | 0.10 | 0.09 |
| Example 10 | 32.0 | 32.0 | 0.0 | 0.0 | 0.83 | 0.1 | 0.2 | 0.0 | 0.0 | 0.3 | 0.0 | bal. | 0.06 | 0.10 | 0.09 |
| Example 11 | 32.0 | 32.0 | 0.0 | 0.0 | 0.83 | 0.1 | 0.2 | 0.0 | 0.0 | 0.0 | 0.3 | bal. | 0.05 | 0.11 | 0.09 |
| Example 12 | 32.0 | 32.0 | 0.0 | 0.0 | 0.83 | 0.1 | 0.5 | 0.0 | 0.0 | 0.0 | 0.0 | bal. | 0.04 | 0.12 | 0.09 |
| Example 13 | 31.5 | 31.5 | 0.0 | 0.0 | 0.87 | 0.1 | 0.2 | 0.3 | 0.0 | 0.0 | 0.0 | bal. | 0.04 | 0.10 | 0.08 |
| Example 14 | 31.5 | 31.5 | 0.0 | 0.0 | 0.92 | 0.1 | 0.2 | 0.2 | 0.0 | 0.0 | 0.0 | bal. | 0.04 | 0.09 | 0.09 |
| Example 15 | 31.5 | 31.5 | 0.0 | 0.0 | 0.91 | 0.1 | 0.2 | 0.2 | 0.0 | 0.0 | 0.0 | bal. | 0.05 | 0.09 | 0.09 |
| Example 16 | 32.0 | 25.0 | 7.0 | 0.0 | 0.83 | 0.1 | 0.2 | 0.5 | 0.0 | 0.0 | 0.0 | bal. | 0.05 | 0.10 | 0.06 |
| Example 17 | 32.0 | 31.0 | 0.0 | 1.0 | 0.83 | 0.1 | 0.2 | 0.5 | 0.0 | 0.0 | 0.0 | bal. | 0.04 | 0.09 | 0.06 |
| Example 18 | 33.0 | 33.0 | 0.0 | 0.0 | 0.70 | 0.7 | 0.2 | 1.3 | 0.0 | 0.0 | 0.0 | bal. | 0.04 | 0.15 | 0.06 |
| Comparative Example 1 | 30.0 | 30.0 | 0.0 | 0.0 | 1.00 | 0.5 | 0.2 | 0.0 | 0.0 | 0.0 | 0.0 | bal. | 0.04 | 0.09 | 0.12 |
| Comparative Example 2 | 30.5 | 22.0 | 6.5 | 2.0 | 1.00 | 0.5 | 0.2 | 0.0 | 0.0 | 0.0 | 0.0 | bal. | 0.04 | 0.10 | 0.11 |
| Comparative Example 3 | 32.0 | 32.0 | 0.0 | 0.0 | 0.93 | 0.1 | 0.2 | 0.3 | 0.0 | 0.0 | 0.0 | bal. | 0.04 | 0.09 | 0.11 |

| | Firing process | | Aging process 1 | | Aging process 2 | | | Magnetic properties | | |
|---|---|---|---|---|---|---|---|---|---|---|
| Sample No. | Temp ° C. | Time hr | Temp ° C. | Time hr | Temp ° C. | Time hr | Cooling rate ° C./min | Br kG | Hcj kOe | Demagnetization rate at high temp. % |
| Example 1 | 1030 | 4 | 900 | 1 | 500 | 20 | 600 | 13.3 | 26.0 | −0.2 |
| Example 2 | 1030 | 4 | 900 | 1 | 500 | 1 | 600 | 13.3 | 25.0 | −0.2 |
| Example 3 | 1030 | 4 | 900 | 1 | 500 | 20 | 300 | 13.5 | 24.0 | −0.3 |
| Example 4 | 1030 | 4 | 900 | 1 | 500 | 1 | 300 | 13.5 | 23.0 | −0.3 |
| Example 5 | 1030 | 4 | 900 | 1 | 500 | 20 | 600 | 13.7 | 23.0 | −0.3 |
| Example 6 | 1030 | 4 | 900 | 1 | 500 | 10 | 600 | 13.7 | 22.5 | −0.4 |
| Example 7 | 1030 | 4 | 900 | 1 | 500 | 5 | 600 | 13.7 | 22.0 | −0.4 |
| Example 8 | 1030 | 4 | 900 | 1 | 500 | 1 | 600 | 13.7 | 21.7 | −0.3 |
| Example 9 | 1030 | 4 | 900 | 1 | 500 | 1 | 100 | 13.7 | 19.5 | −0.9 |
| Example 10 | 1030 | 4 | 900 | 1 | 500 | 1 | 100 | 13.7 | 19.2 | −1.0 |
| Example 11 | 1030 | 4 | 900 | 1 | 500 | 1 | 100 | 13.7 | 19.4 | −0.8 |
| Example 12 | 1030 | 4 | 900 | 1 | 500 | 1 | 100 | 13.6 | 19.8 | −0.7 |
| Example 13 | 1030 | 4 | 900 | 1 | 500 | 1 | 300 | 13.8 | 20.0 | −0.7 |
| Example 14 | 1030 | 4 | 900 | 1 | 500 | 1 | 550 | 13.9 | 19.0 | −1.2 |
| Example 15 | 1050 | 4 | 900 | 1 | 500 | 1 | 300 | 14.0 | 18.0 | −1.5 |
| Example 16 | 1030 | 4 | 900 | 1 | 500 | 1 | 600 | 13.7 | 21.7 | −0.3 |
| Example 17 | 1030 | 4 | 900 | 1 | 500 | 1 | 650 | 13.5 | 24.0 | −0.3 |
| Example 18 | 1030 | 4 | 900 | 1 | 500 | 72 | 600 | 12.6 | 15.9 | −0.1 |
| Comparative Example 1 | 1050 | 4 | 900 | 1 | 500 | 1 | 40 | 14.2 | 15.0 | −8.0 |
| Comparative Example 2 | 1050 | 4 | 900 | 1 | 500 | 1 | 60 | 13.8 | 18.0 | −4.0 |
| Comparative Example 3 | 1030 | 4 | 900 | 1 | Without aging process 2 | | | 13.8 | 12.1 | −4.2 |

TABLE 1-continued

| | Generation and composition (atomic %) of first and second crystal boundary phases | | | | | | | |
|---|---|---|---|---|---|---|---|---|
| | First crystal boundary phase | | | | Second crystal boundary phase | | | |
| Sample No. | With/ without | R | T | M | With/ without | R | T | M |
| Example 1 | ○ | 30.5 | 61.8 | 4.9 | ○ | 62.1 | 17.6 | 8.9 |
| Example 2 | ○ | 29.8 | 59.1 | 4.9 | ○ | 66.3 | 16.9 | 8.4 |
| Example 3 | ○ | 27.7 | 63.3 | 4.4 | ○ | 63.0 | 19.9 | 7.9 |
| Example 4 | ○ | 27.3 | 61.1 | 5.3 | ○ | 58.3 | 20.3 | 12.3 |
| Example 5 | ○ | 30.7 | 58.3 | 4.3 | ○ | 59.3 | 23.5 | 9.9 |
| Example 6 | ○ | 31.1 | 62.9 | 4.3 | ○ | 54.9 | 22.0 | 10.3 |
| Example 7 | ○ | 27.4 | 59.1 | 4.8 | ○ | 63.0 | 21.3 | 9.1 |
| Example 8 | ○ | 24.7 | 65.6 | 3.1 | ○ | 59.0 | 21.9 | 3.2 |
| Example 9 | ○ | 32.4 | 60.3 | 3.9 | ○ | 58.0 | 20.3 | 7.3 |
| Example 10 | ○ | 26.4 | 61.3 | 2.9 | ○ | 62.1 | 22.1 | 6.9 |
| Example 11 | ○ | 29.3 | 58.1 | 3.3 | ○ | 59.9 | 21.4 | 5.8 |
| Example 12 | ○ | 28.3 | 57.3 | 3.9 | ○ | 58.3 | 22.3 | 8.9 |
| Example 13 | ○ | 28.7 | 64.3 | 4.8 | ○ | 63.0 | 20.0 | 10.0 |
| Example 14 | ○ | 29.4 | 60.1 | 4.8 | ○ | 63.6 | 21.1 | 9.1 |
| Example 15 | ○ | 29.7 | 63.9 | 4.9 | ○ | 62.4 | 21.1 | 9.6 |
| Example 16 | ○ | 29.1 | 59.3 | 5.8 | ○ | 58.3 | 20.3 | 7.8 |
| Example 17 | ○ | 28.9 | 59.9 | 4.8 | ○ | 54.3 | 18.9 | 8.9 |
| Example 18 | ○ | 28.6 | 58.3 | 5.8 | ○ | 59.1 | 16.3 | 12.1 |
| Comparative Example 1 | x | | | | x | | | |
| Comparative Example 2 | x | | | | x | | | |
| Comparative Example 3 | x | | | | ○ | 58.1 | 23.1 | 9.6 |

It can be known from Table 1 that the absolute values of demagnetization rate at a high temperature in samples of Examples 1 to 18 were lower than 4%. In other words, the absolute values of demagnetization rates at a high temperature were inhibited to a low level so these samples became rare earth based magnets that can be used at high temperature environments. In Comparative Examples 1 to 3, the absolute value of demagnetization rate at a high temperature was 4% or more, suggesting no inhibitory effect on the demagnetization rate at a high temperature. As for the R-T-M based compound observed at any sections of samples 1 to 31, the value of saturation magnetization of the R-T-M based compound was determined to be 5% or less of that of $Nd_2Fe_{14}B$ compound after the analysis of magnetic flux distribution based on the electron holography, suggesting that the R-T-M based compound was not a phase exhibiting ferromagnetism. Thus, it can be known that the inhibitory effect on the demagnetization rate at a high temperature was achieved by containing both the first crystal boundary phases and the second crystal boundary phases in Examples 1 to 31.

In addition, it can be known from Table 2 that if the ratio of the area of the first crystal boundary phases to the area of the second crystal boundary phases was 0.5 or more at the section, the absolute value of the demagnetization rate at a high temperature was 3% or less. Thus, the samples with such a ratio would be more preferable. Specifically, for Examples 1 to 18, the ratio of the area of the first crystal boundary phases to the area of the second crystal boundary phases was 0.5 or more.

TABLE 2

| | Composition of sintered magnet (mass %) | | | | | | | | | | | | | | |
|---|---|---|---|---|---|---|---|---|---|---|---|---|---|---|---|
| | R | | | | | | M | | | | | | | | |
| Sample No. | Sum | Nd | Pr | Dy | B | Cu | Al | Ga | Si | Ge | Sn | Fe | N | C | O |
| Example 19 | 32.0 | 25.0 | 7.0 | 0.0 | 0.87 | 0.1 | 0.2 | 0.6 | 0.0 | 0.0 | 0.0 | bal. | 0.04 | 0.10 | 0.08 |
| Example 20 | 32.0 | 25.0 | 7.0 | 0.0 | 0.87 | 0.1 | 0.2 | 0.6 | 0.0 | 0.0 | 0.0 | bal. | 0.04 | 0.10 | 0.05 |
| Example 21 | 32.0 | 25.0 | 7.0 | 0.0 | 0.87 | 0.1 | 0.2 | 0.6 | 0.0 | 0.0 | 0.0 | bal. | 0.05 | 0.11 | 0.08 |
| Example 22 | 32.0 | 25.0 | 7.0 | 0.0 | 0.87 | 0.1 | 0.2 | 0.6 | 0.0 | 0.0 | 0.0 | bal. | 0.04 | 0.12 | 0.09 |
| Example 23 | 32.0 | 25.0 | 7.0 | 0.0 | 0.87 | 0.1 | 0.2 | 0.6 | 0.0 | 0.0 | 0.0 | bal. | 0.06 | 0.09 | 0.09 |
| Example 24 | 32.0 | 25.0 | 7.0 | 0.0 | 0.87 | 0.1 | 0.2 | 0.6 | 0.0 | 0.0 | 0.0 | bal. | 0.04 | 0.12 | 0.08 |
| Example 25 | 32.0 | 25.0 | 7.0 | 0.0 | 0.87 | 0.1 | 0.2 | 0.6 | 0.0 | 0.0 | 0.0 | bal. | 0.04 | 0.10 | 0.07 |
| Example 26 | 30.5 | 23.0 | 7.5 | 0.0 | 0.90 | 0.1 | 0.2 | 0.2 | 0.0 | 0.0 | 0.0 | bal. | 0.06 | 0.12 | 0.09 |
| Example 27 | 32.0 | 26.0 | 6.0 | 0.0 | 0.86 | 0.2 | 0.1 | 0.5 | 0.0 | 0.0 | 0.0 | bal. | 0.04 | 0.12 | 0.09 |
| Example 28 | 31.5 | 25.0 | 6.5 | 0.0 | 0.85 | 0.3 | 0.2 | 0.6 | 0.0 | 0.0 | 0.0 | bal. | 0.04 | 0.09 | 0.05 |
| Example 29 | 32.0 | 32.0 | 0.0 | 0.0 | 0.87 | 0.1 | 0.2 | 0.6 | 0.0 | 0.0 | 0.0 | bal. | 0.04 | 0.12 | 0.11 |
| Example 30 | 32.0 | 32.0 | 0.0 | 0.0 | 0.87 | 0.1 | 0.2 | 0.6 | 0.0 | 0.0 | 0.0 | bal. | 0.05 | 0.10 | 0.10 |
| Example 31 | 32.0 | 32.0 | 0.0 | 0.0 | 0.87 | 0.1 | 0.2 | 0.6 | 0.0 | 0.0 | 0.0 | bal. | 0.05 | 0.10 | 0.11 |

TABLE 2-continued

| Sample No. | Firing process Temp ° C. | Firing process Time hr | Aging process 1 Temp ° C. | Aging process 1 Time hr | Aging process 2 Temp ° C. | Aging process 2 Time hr | Aging process 2 Cooling rate ° C./min | Magnetic properties Br kG | Magnetic properties Hcj kOe | Magnetic properties Demagnetization rate at high temp. % |
|---|---|---|---|---|---|---|---|---|---|---|
| Example 19 | 1030 | 4 | 900 | 1 | 500 | 5 | 550 | 13.1 | 18.0 | −1.2 |
| Example 20 | 1030 | 4 | 900 | 1 | 500 | 1 | 550 | 13.3 | 21.3 | −0.4 |
| Example 21 | 1030 | 4 | 900 | 1 | 500 | 0.5 | 550 | 13.4 | 19.1 | −0.9 |
| Example 22 | 1030 | 4 | 900 | 1 | 500 | 0.2 | 550 | 13.5 | 16.3 | −1.2 |
| Example 23 | 1030 | 4 | 900 | 1 | 650 | 0.2 | 600 | 13.4 | 18.2 | −1.3 |
| Example 24 | 1030 | 4 | 900 | 1 | 650 | 0.5 | 600 | 13.4 | 19.3 | −0.8 |
| Example 25 | 1030 | 4 | 900 | 1 | 650 | 1 | 600 | 13.1 | 20.3 | −0.8 |
| Example 26 | 1030 | 4 | 900 | 1 | 500 | 1 | 100 | 13.9 | 16.8 | −1.1 |
| Example 27 | 1040 | 3 | 900 | 1 | 500 | 1 | 300 | 13.8 | 19.1 | −0.9 |
| Example 28 | 1050 | 2 | 900 | 1 | 500 | 1 | 300 | 13.8 | 23.3 | −0.5 |
| Example 29 | 1030 | 4 | 900 | 1 | Without aging process 2 | | | 13.5 | 11.0 | −3.3 |
| Example 30 | 1030 | 4 | 900 | 1 | 800 | 0.2 | 300 | 12.3 | 12.5 | −3.2 |
| Example 31 | 1030 | 4 | 900 | 1 | 800 | 1 | 300 | 11.2 | 11.5 | −3.8 |

| Sample No. | Area ratio of first crystal boundary phase % | Area ratio of second crystal boundary phase % | Ratio of the area of the first crystal boundary phase to the area of the second crystal boundary phase (first crystal boundary phase/second crystal boundary phase) |
|---|---|---|---|
| Example 19 | 6.0 | 2.1 | 2.9 |
| Example 20 | 4.8 | 2.4 | 2.0 |
| Example 21 | 2.2 | 2.9 | 0.8 |
| Example 22 | 1.6 | 2.7 | 0.6 |
| Example 23 | 2.1 | 2.9 | 0.7 |
| Example 24 | 3.4 | 2.8 | 1.2 |
| Example 25 | 5.8 | 1.9 | 3.1 |
| Example 26 | 0.7 | 0.2 | 3.5 |
| Example 27 | 4.4 | 1.7 | 2.6 |
| Example 28 | 6.1 | 1.8 | 3.4 |
| Example 29 | 0.6 | 3.1 | 0.2 |
| Example 30 | 0.8 | 2.5 | 0.3 |
| Example 31 | 1.0 | 2.8 | 0.4 |

TABLE 3

| Sample No. | Atomic ratio [B]/([Nd] + [Pr]) | Atomic ratio ([M] + [C])/[B] | Atomic ratio [O]/([C] + [N]) |
|---|---|---|---|
| Example 1 | 0.28 | 0.59 | 0.39 |
| Example 2 | 0.28 | 0.59 | 0.35 |
| Example 3 | 0.33 | 0.39 | 0.39 |
| Example 4 | 0.33 | 0.38 | 0.37 |
| Example 5 | 0.35 | 0.34 | 0.39 |
| Example 6 | 0.35 | 0.33 | 0.35 |
| Example 7 | 0.35 | 0.33 | 0.32 |
| Example 8 | 0.35 | 0.34 | 0.26 |
| Example 9 | 0.35 | 0.20 | 0.51 |
| Example 10 | 0.35 | 0.26 | 0.45 |
| Example 11 | 0.35 | 0.25 | 0.44 |
| Example 12 | 0.35 | 0.37 | 0.44 |
| Example 13 | 0.37 | 0.25 | 0.45 |
| Example 14 | 0.39 | 0.21 | 0.55 |
| Example 15 | 0.39 | 0.21 | 0.51 |
| Example 16 | 0.34 | 0.30 | 0.32 |
| Example 17 | 0.36 | 0.29 | 0.36 |
| Example 18 | 0.28 | 0.59 | 0.25 |
| Example 19 | 0.36 | 0.30 | 0.45 |
| Example 20 | 0.36 | 0.30 | 0.28 |
| Example 21 | 0.36 | 0.31 | 0.39 |
| Example 22 | 0.36 | 0.32 | 0.44 |
| Example 23 | 0.36 | 0.29 | 0.48 |
| Example 24 | 0.36 | 0.32 | 0.39 |
| Example 25 | 0.36 | 0.30 | 0.39 |
| Example 26 | 0.39 | 0.24 | 0.40 |
| Example 27 | 0.36 | 0.26 | 0.44 |
| Example 28 | 0.36 | 0.30 | 0.30 |
| Example 29 | 0.36 | 0.32 | 0.54 |
| Example 30 | 0.36 | 0.30 | 0.53 |

TABLE 3-continued

| Sample No. | Atomic ratio [B]/([Nd] + [Pr]) | Atomic ratio ([M] + [C])/[B] | Atomic ratio [O]/([C] + [N]) |
|---|---|---|---|
| Example 31 | 0.36 | 0.30 | 0.58 |
| Comparative Example 1 | 0.44 | 0.16 | 0.73 |
| Comparative Example 2 | 0.47 | 0.17 | 0.62 |
| Comparative Example 3 | 0.39 | 0.22 | 0.67 |

Figure 3B:
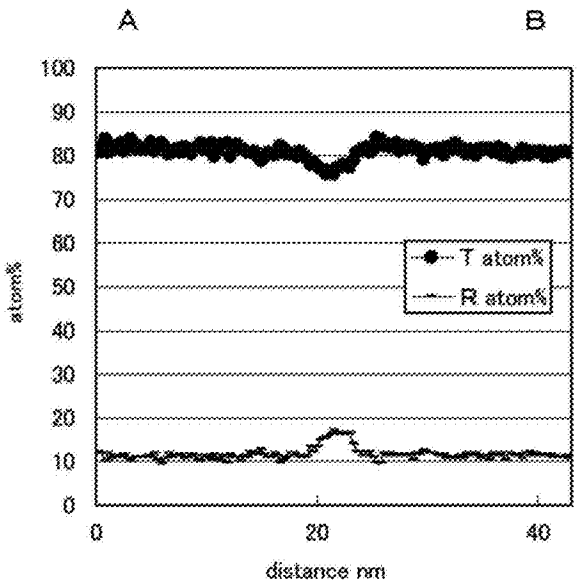
FIGS. 3A and 3B are graphs showing the two-grain boundary phase of the rare earth based magnet in Comparative Example 2 of the present embodiment.
Figure 3A:
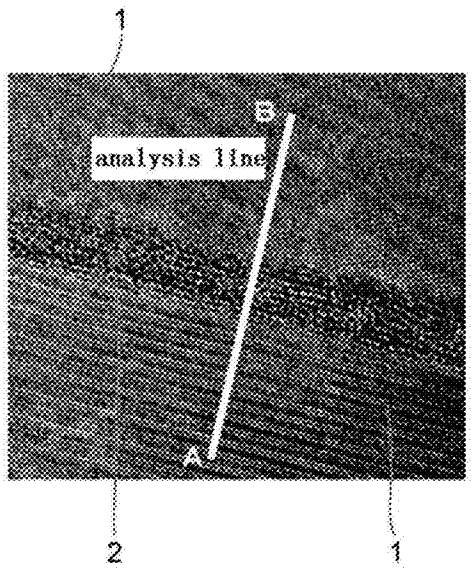

FIG. 3A was the HRTEM image showing the two-grain boundary phases in Comparative Example 2 (which was the prior art). FIG. 3B showed the concentration distributions of Fe (T) and Nd (R) determined by the line analysis via STEM-EDS between A and B, wherein the analysis line A-B crossed the two-grain boundary phase 2 shown in FIG. 3A. It can be predicted from the element analysis via STEM-EDS that the two-grain boundary phase of Comparative Example 2 contained 75 at. % or more of Fe atoms and was ferromagnetic. In this respect, if the crystal boundary phases did not contain the first crystal boundary phases and the second crystal boundary phases which two had different R-T-M ratios, a two-grain boundary phase of the prior art would be generated where the iron family elements were present in high concentrations so that the main phase crystal grains would not be magnetically cut off Thus, the inhibitory effect on the demagnetization rate at a high temperature would not be improved.

Figure 4B:
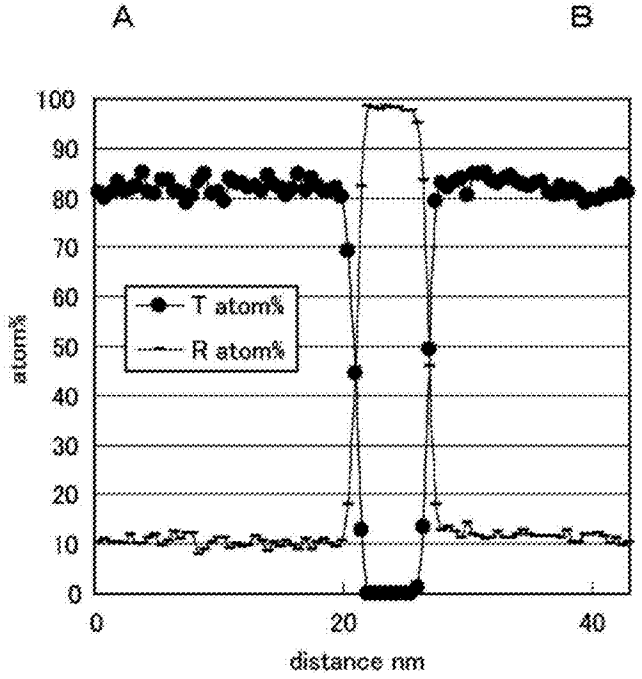
FIGS. 4A and 4B are graphs showing the two-grain boundary phase of the rare earth based magnet according to the present embodiment of the present invention.
Figure 4A:
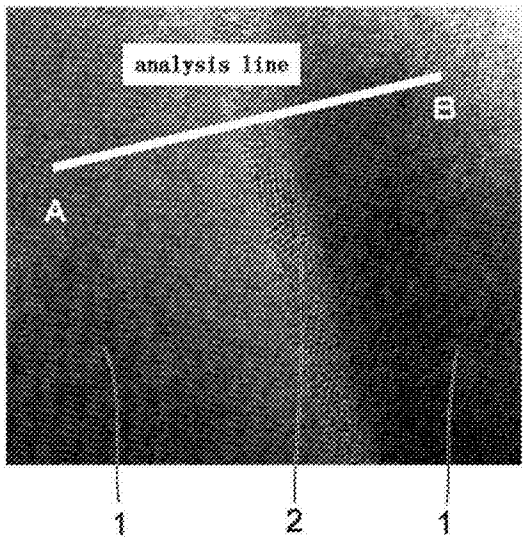

FIG. 4A was the HRTEM image showing the two-grain boundary phases in Example 26 of the present invention. FIG. 4B showed the concentration distributions of Fe (T) and Nd (R) determined by the line analysis via STEM-EDS between A and B, wherein the analysis line A-B crossed the two-grain boundary phase 2 shown in FIG. 4A. It can be predicted from the element analysis via STEM-EDS that the two-grain boundary phase was formed in Example 26 with the concentration of Fe being lower than 10 at. %. Further, it is presumed that such a two-grain boundary phase was non-ferromagnetic. In this respect, as the crystal boundary phases contained the first crystal boundary phases and the second crystal boundary phases which two had different R-T-M ratios, a two-grain boundary phase was formed with its concentration of the iron family elements being lower than that in the prior art. Thus, magnetic isolation among main phase crystal grains was improved, and an inhibitory effect on the demagnetization rate at a high temperature was produced. In addition, the two-grain boundary phase with lowered concentration of the iron family elements was also seen in Examples 1 to 31 in which the first crystal boundary phases and the second crystal boundary phases with different R-T-M ratios were contained.

In addition, as shown in Table 3, in samples 1 to 18 which met the requirements of the present invention, the R-T-M based compound mentioned above was contained in the sintered magnet, and the numbers of Nd, Pr, B, C and M atoms contained in the sintered magnet satisfied the following specific correlations. That was, when the numbers of Nd, Pr, B, C and M atoms were referred to as [Nd], [Pr], [B], [C] and [M], $0.27<[B]/([Nd]+[Pr])<0.40$ and $0.07<([M]+[C])/[B]<0.60$. Thus, as $0.27<[B]/([Nd]+[Pr])<0.40$ and $0.07<([M]+[C])/[B]<0.60$, the coercivity (Hcj) can be effectively improved.

Further, as shown in Table 3, in samples 1 to 18 which met the requirements of the present invention, the sintered magnet contained the R-T-M based compound mentioned above and the numbers of 0, C and N atoms contained in the sintered magnet satisfied the following specific correlations. That was, when the numbers of O, C and N atoms were referred to as [O], [C] and [N] respectively, $[O]/([C]+[N])<0.60$. Thus, as $[O]/([C]+[N])<0.60$, the demagnetization rate D at a high temperature can be effectively inhibited.

As described in these examples, in the rare earth based magnet of the present invention, the R-T-M based crystal compound having R, T and M formed non-ferromagnetic crystal boundary phases in the sintered body by containing the rare earth element R, iron family element T and M (which formed the ternary eutectic point with R and T) in the crystal boundary phases which were subjected to a proper aging treatment and satisfy the correlations mentioned above. As a result, the concentration of T in the two-grain boundary phases can be lowered so that the two-grain boundary phases became non-ferromagnetic crystal boundary phases. In this way, the effect of cutting off the magnetic coupling among adjacent $R_2T_{14}B$ main phase crystal grains can be improved so that the demagnetization rate at a high temperature was inhibited to a low level.

The present invention has been disclosed based on the embodiments. These embodiments are only illustrative and can be modified and changed within the scope of the claims of the present invention. Further, those skilled in the art will realize that these modifications and changes are within the scope of claims of the present invention. Thus, the description in the specification and the drawings should be considered as illustrative but not limited.

According to the present invention, a rare earth based magnet can be provided which can be used at a high temperature environment.

DESCRIPTION OF REFERENCE NUMERALS

1 main phase crystal grain
2 two-grain boundary phase
3 crystal boundary phase

What is claimed is:

1. A rare earth based magnet, comprising, $R_2T_{14}B$ main phase crystal grains and crystal boundary phases, with at least a first crystal boundary phase and a second crystal boundary phase being contained, wherein, the first crystal boundary phase contains at least R-T-M in the following ranges, R: 20 to 40 atomic %, T: 60 to 75 atomic %, M: 1 to 10 atomic %;

the second crystal boundary phase contains at least R-T-M in the following ranges, R: 50 to 70 atomic %, T: 10 to 30 atomic %, M: 1 to 20 atomic %;

R represents the rare earth element, T represents at least one iron family element with Fe as essential, and M represents at least one element selected from the group consisting of Al, Ge, Si, Sn and Ga;

the rare earth based magnet contains O, C, and N, and the numbers of O, C, and N atoms contained in the rare earth based magnet are referred to as [O], [C], and [N], in which $[O]/([C]+[N])<0.60$, and an absolute value of a demagnetization rate D at a high temperature is inhibited to 4% or less, in which $D=100\times(B1-B0)/B0(\%)$, B0: residual magnetic flux at room temperature (25° C.), and B1: residual magnetic flux brought back to room temperature after being exposed to a temperature of 140° C. for 2 hours.

2. The rare earth based magnet of claim 1, wherein, the ratio of the area of said first crystal boundary phase to the area of said second crystal boundary phases is 0.5 or more at any section having about 200 main phase grains.

3. The rare earth based magnet of claim 1, wherein, the rare earth based magnet contains Nd, Pr, B, C, and M, and the numbers of Nd, Pr, B, C, and M atoms contained in the rare earth based magnet are referred to as [Nd], [Pr], [B], [C] and [M], in which $0.27<[B]/([Nd]+[Pr])<0.40$ and $0.07<([M]+[C])/[B]<0.60$.

4. The rare earth based magnet of claim 1, wherein, the second crystal boundary phase contains R in the following range, R: 54.3 to 66.3 atomic %.

5. The rare earth based magnet of claim 1, wherein, the ratio of the area of said first crystal boundary phase to the area of said second crystal boundary phases is 0.5 or more to 3.5 or less at any section having about 200 main phase grains.

* * * * *